US005840095A

United States Patent [19]

Kawamura et al.

[11] Patent Number: 5,840,095

[45] Date of Patent: Nov. 24, 1998

[54] METHOD AND APPARATUS FOR PRODUCING FLAT METAL POWDER DIRECTLY FROM MELT

[75] Inventors: Taizo Kawamura; Yoshio Harakawa; Hitoshi Yamaguchi, all of Tokyo, Japan

[73] Assignees: Teikoku Piston Ring Co., Ltd., Tokyo; Research Development Corporation, Kawaguchi, both of Japan

[21] Appl. No.: 691,260

[22] Filed: Aug. 2, 1996

Related U.S. Application Data

[63] Continuation of Ser. No. 355,264, Dec. 8, 1994, abandoned.

[30] Foreign Application Priority Data

Dec. 9, 1993 [JP] Japan ..... 5-309442

[51] Int. Cl.[6] ..... B22F 9/08

[52] U.S. Cl. ..... 75/334; 75/338; 164/46; 508/451; 508/459

[58] Field of Search ..... 75/333, 334, 338; 164/46; 508/451, 459, 538, 539

[56] References Cited

U.S. PATENT DOCUMENTS

| | | | |
|---|---|---|---|
| 3,915,869 | 10/1975 | Katono et al. | 252/49.5 |
| 4,138,348 | 2/1979 | Grasshoff | 252/49.5 |
| 4,752,405 | 6/1988 | Kylb et al. | 252/56 R |
| 5,076,339 | 12/1991 | Smith | 252/51.5 A |

FOREIGN PATENT DOCUMENTS

| | | | |
|---|---|---|---|
| 1-287209 | 11/1989 | Japan . | |
| 1-319606 | 12/1989 | Japan | 75/334 |
| 4-183802 | 6/1992 | Japan | 75/334 |
| 5-263111 | 10/1993 | Japan . | |

*Primary Examiner*—George Wyszomierski
*Attorney, Agent, or Firm*—Armstrong, Westerman, Hattori, McLeland & Naughton

[57] ABSTRACT

The yield of flat powder (6) of Al, Mg or their alloy is enhanced by forming, on a rotary cooling body (4), a film (8) which can prevent the flat metal powder (8) from sticking to the cooling surface. The film (8) adheres to the cooling surface at a force which is sufficient for forming the film but which enables the film material to adhere to the flat powder which then separates from the cooling body (4). The film consists essentially of at least one liquid lower fatty acid and at least one solid higher fatty acid.

5 Claims, 3 Drawing Sheets

METHOD AND APPARATUS FOR PRODUCING FLAT METAL POWDER DIRECTLY FROM MELT

This application is a continuation of application Ser. No. 08/355,264 filed Dec. 8, 1994, now abandoned.

BACKGROUND OF INVENTION

1. Field of the Invention

The present invention relates to a method and apparatus for producing flat metal powder directly from metallic melt. More particularly, the present invention relates to a method and apparatus for producing, at high yield, a flat powder consisting of amorphous metal or quenched metal having a particularly low specific gravity, which metal having tendency to stick on a cooling body.

2. Description of Related Arts

The flat metal powder, which has a flat and smooth surface and a large aspect ratio (length/thickness), has such a peculiar geometric shape that its application to ornamental painting or magnetic material is highly valued.

According to Japanese Unexamined Patent Publication No. 1-287,209, the flat powder can be produced directly from a metallic melt, as is hereinafter described with reference to FIG. 3.

Referring to FIG. 3, which illustrates a conventional apparatus for producing flat powder, an alloy having a specified composition is melted in a crucible 10 which is located in a melting chamber whose protective gas pressure is adjustable. The alloy melt 1 is then heated up to a spraying temperature which is generally higher than the liquidus temperature by approximately 150° C. A stopper (not shown), which closes the inlet of the melt nozzle 2, is pulled up, allowing the alloy melt 1 to start to flow down through the outlet of the melt nozzle 2, which is located in the spraying chamber. Simultaneously, high-pressure gas is ejected toward the melt stream through high-pressure nozzles 3 which are located in the vicinity of the outlet of the melt nozzle 2. Thus, the alloy melt is finely divided into droplets 5 which simultaneously scatter downwards. A rotary cooling body 4 is located below the melt nozzle 2 and is preliminarily rotated. The droplets 5 are impinged on the surface of the rotary cooling body 4 to convert the droplets 5 into a flat shape and to simultaneously solidify by quenching. The solidified flat powder 6 is separated from the cooling surface of the rotary cooling body 4 under the action of centrifugal force and is conveyed into a cyclone apparatus by a circulating gas stream. The flat powder 6 is thus collected in the cyclone apparatus.

In the above described method, unless the flat powder is completely separated from the cooling body under the action of centrifugal force, the flat powder adheres to the cooling surface of the cooling body and new droplets are then impinged on the adhered flat powder. The flakes of the powder are now bonded to each other to form granules in the form of a string of beads. In an extreme case, there arises the problem of the droplets piling on the cooling surface of a rotary cooling body, thereby lowering the yield of flat powder.

Heretofore, the known method of producing the flat powder at high yield is by the following measures.

(1) The flowing rate of the melt through the melt nozzle is decreased to a range where it does not clog.

(2) The rotation rate of the rotary cooling body is increased.

(3) The pressure of the high-pressure gas is adjusted to a range where clogging does not occur in a particular melt nozzle.

(4) The rate of cooling of the cooling surface of a rotary cooling body is intensified.

(5) A hardening surface-treatment is applied to the surface of a rotary cooling body.

(6) The metal used for a rotary cooling body is specified so that its ratio of yield strength relative to specific, hardness and thermal conductivity are specified to particular values, as is proposed by one of the present assignees in Japanese Unexamined Patent Publication No. 5-263,111.

These measures (1) through (6) are effective for powder of such metals as Fe alloy, Ni alloy, Ti alloy or Co alloy having a relatively high specific gravity, but are not satisfactorily effective for such metals as Al alloy and Mg alloy having a relatively low specific gravity. Since the centrifugal force applied to a metal having low specific gravity is inherently low, the powder sticks to the cooling body notwithstanding the measures (1) through (6). The powder, which impinges upon the already adhered powder, therefore further sticks to the latter powder, which tendency is not at all suppressed.

SUMMARY OF THE INVENTION

It is an object of the present invention to provide a method for producing a flat powder of metal, which has a particularly low specific gravity, at high yield.

It is another object of the present invention to provide an apparatus for producing a flat powder of metal, which has a particularly low specific gravity, at high yield.

In accordance with an object of the present invention, there is provided a method for producing a flat powder directly from metallic melt, comprising the steps of:

adhering, on a cooling surface of a cooling body, a film-forming means for preventing the flat powder from sticking to the cooling surface;

imparting rotation to the cooling body;

flowing the metallic melt through a melt nozzle to form a melt stream;

applying gas pressure to the melt stream, thereby finely dividing the melt stream to droplets;

impinging the droplets on the cooling surface of the cooling body, thereby simultaneously flattening and solidifying the droplets; and, separating the flat metal powder from the cooling surface.

In accordance with another object of the present invention, there is also provided an apparatus for producing a flat metal powder, comprising:

a melt-nozzle for flowing metallic melt down through an outlet thereof and forming a metallic melt stream;

a gas-nozzle for applying gas pressure on the metallic melt stream, located in the vicinity of said outlet;

a rotary cooling body located below said melt-nozzle and said gas nozzle; and, a means for applying, on a cooling surface of the rotary cooling body, a film for preventing the flat metal powder from sticking to the cooling surface during rotation of the rotary cooling means.

DESCRIPTION OF PREFERRED EMBODIMENTS

The present invention is hereinafter described in detail.

Preferably, the metal of the flat powder consists of Al, Mg, or their alloy.

Flat powder herein indicates the powder having major upper and lower surfaces and having preferably aspect ratio of 5 or more.

The centrifugal force, which is applied to a metal having low specific gravity, is so low that it does not promote the separation of the powder from the cooling body, but this can be aided by providing a film-forming means (hereinafter referred to as "the anti-sticking film") for preventing the sticking of the flat powder on the cooling surface. The film-bonding force on the cooling body is adjusted to such an extent that the film adheres to the powder which has been separated from the cooling body. The concept "film adheres to the cooling body" means therefore that the film is not rigidly bonded to the cooling body but merely adheres to the cooling body so that the film also adheres to the flat powder which becomes separated from the cooling body. The powder can therefore be separated from the cooling body at low separating force, because the powder can be easily separated from the film.

The anti-sticking film according to the present invention may consist of a liquid or a liquid mixture selected from the group consisting of oil, lower fatty acid and higher fatty acid. Preferably, the liquid or liquid mixture is selected from the group consisting of oleic acid, linoleic acid, stearic acid, lauric acid, palmitic acid, methacrylic acid, and a salt of one of these acids. The anti-sticking film according to the present invention may consist of a solid selected from the group consisting of soap, beeswax and resin having an adequately low density. The anti-sticking film according to the present invention may consist of a mixture of a liquid and solid mentioned above.

In order to maintain the cooling effect of the cooling body as high as possible, the anti-sticking film preferably has a thickness of not more than 100 $\mu$m before impinging of droplets thereon.

The anti-sticking film prevents the flat powder from sticking and has the function of enhancing the yield of flat powder, presumably because the force required for separation of the anti-sticking film from the cooling body is made greater than the force required for separating the flat powder from the antisticking force and also greater than the separation force of the anti-sticking film from itself; that is, the film is destroyed and its material is dispersed.

In addition, the gas for finely dividing the metallic melt preferably has a pressure of 10 kg/cm$^2$ or more. Furthermore, the impinging speed of the metallic droplets on the cooling body is preferably 10 m/s or more.

A preferable apparatus according to the present invention comprises a conical surface defining the cooling surface and is rotated around a central axis.

According to another preferable apparatus, the means for applying the anti-sticking film is brought into contact with a portion of the rotary cooling body preferably in front of the impinging position of the metallic droplets with regards to the rotational direction of said rotary cooling body.

By means of the apparatus for producing the flat powder according to the present invention, liquid or solid is adhered to the cooling body so as to form an anti-sticking film. Such film is uniformly formed on the cooling surface, due to the utilization of rotation for the application of the liquid or solid on the cooling surface.

The application means preferably comprises a rotary body which has a cylindrical surface and which can cover essentially the whole width of the cooling surface of a cooling body, and a driving means of the rotary cylindrical body, for advancing it toward and retracting it from the cooling body. The rotary application means is brought into contact with and pushed against a portion of the rotary cooling body, said portion being just in front of the impinging position of the metal droplets with regards to the rotary direction of the cooling body. The liquid or solid, which can prevent sticking, hereinafter referred to as "the anti-sticking liquid or solid", is first placed between the rotary cooling body and the rotary application body, and is then quickly and evenly applied on the entire cooling surface.

The rotary application means may be a cylindrical and hollow body and may comprise a plurality of apertures extending through its wall from the hollow portion to the outer cylindrical surface. The anti-sticking liquid can be supplied from the interior of the rotary cylindrical body through the apertures to the inter-space between the rotary cooling body and the rotary cylindrical body. According to a particularly preferable embodiment, a porous resin material, which is impregnated with the anti-sticking liquid, may be provided on the surface of a rotary cooling body.

The anti-sticking film does not impede the heat transfer from the metal droplets to the rotary cooling body, when the metal droplets impinge upon the cooling surface of the rotary cooling body, because the anti-sticking film thickness becomes extremely thin due to impact force and heat transfer from the metal droplets. In addition, since the anti-sticking film is uniformly formed on the rotary cooling body, the anti-sticking film prevents any direct contact between the metal droplets and the rotary cooling body. The material of anti-sticking film, which adheres to the flat powder, can be removed by subsequently rinsing the recovered powder with organic solvent such as acetone, ether and the like.

The present invention is further explained with reference to FIGS. 1, 2, 4 and 5.

Figure 1:
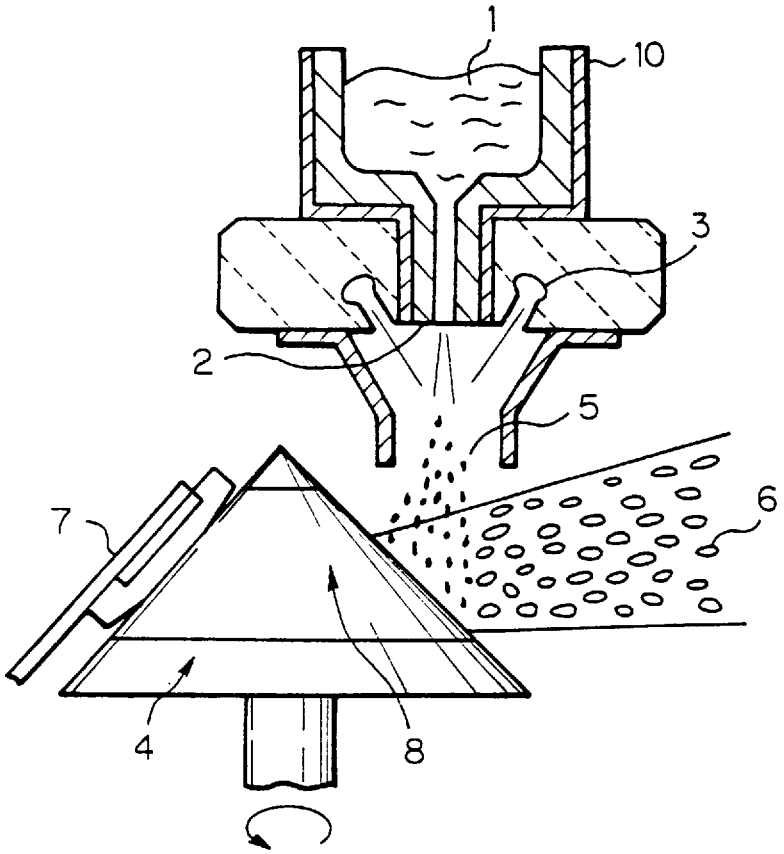
FIG. 1 illustrates an embodiment of the apparatus for producing flat metal powder according to the present invention.

In the apparatus illustrated in FIG. 1, an upper melting chamber, a lower spraying chamber, a cyclone collector for the flat powder, and a circulating duct between the spraying chamber and the cyclone collector are provided but are not shown. The melting chamber and the spraying chamber are separated by a partition wall 15.

Within the melting chamber, a crucible 10 provided with the melt nozzle at the bottom, a high-frequency current coil (not shown), and a stopper for closing and opening the inlet of the melt nozzle 2 are located, following the same construction as that of the conventional apparatus for producing the flat powder. The melt nozzle 2 is fitted in an aperture through the partition wall 15, and has an inlet opening in the bottom of the crucible 10 and an outlet opening in the spraying chamber, which is also the same construction as in the conventional apparatus.

Within the spraying chamber, nozzles 3 for ejecting high-pressure gas, hereinafter referred to as "the high-pressure gas nozzles 3", are located in the vicinity of the melt-nozzle's outlet. A rotary cooling body 4, which has a frusto-conical shape, is located below the high-pressure gas nozzles 3. An anti-sticking film 8 is bonded to the cooling surface of the rotary cooling body 4.

Figure 2:
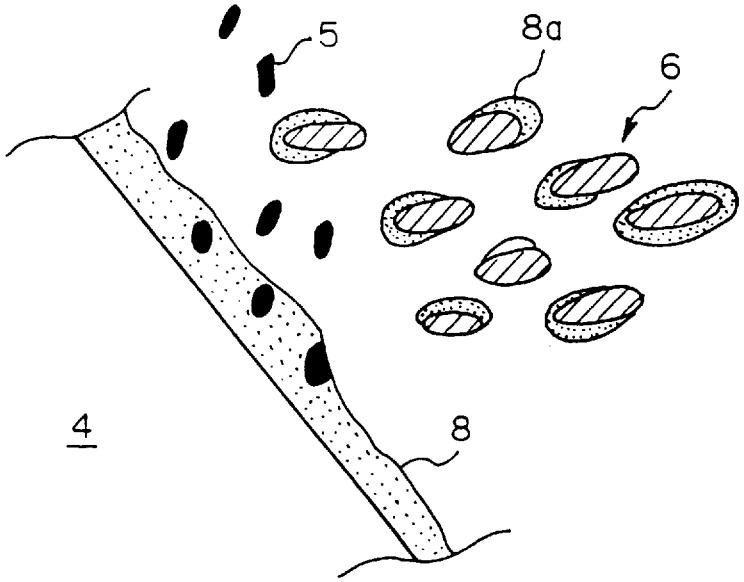
FIG. 2 is an enlarged schematic drawing of the apparatus shown in FIG. 1 in the vicinity of the cooling surface.
Figure 3:
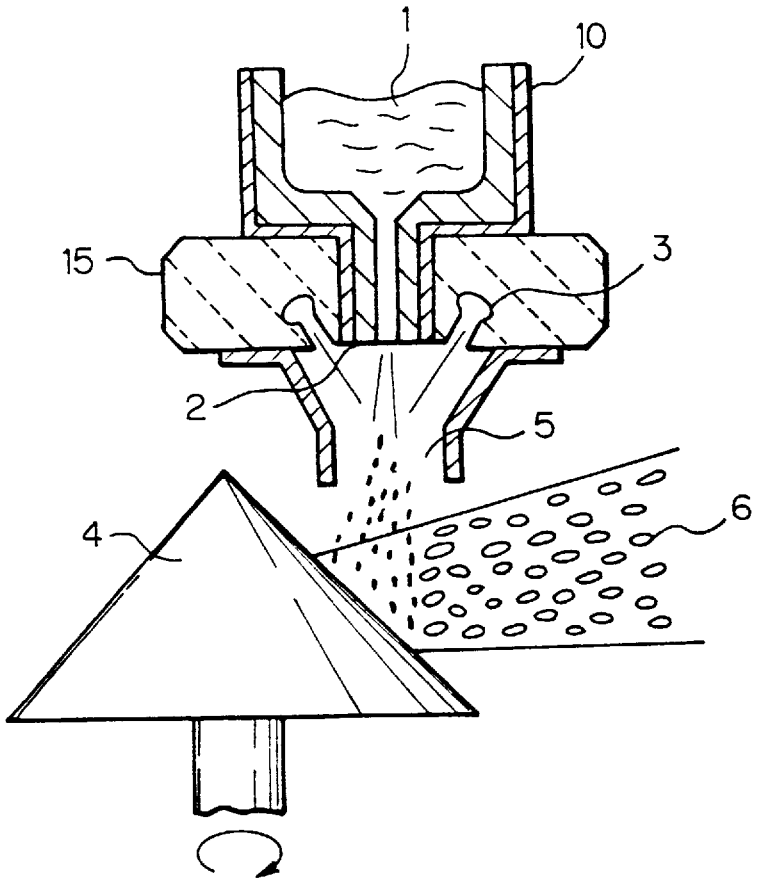
FIG. 3 illustrates an embodiment of the method for producing flat metal powder according to the present invention.

Referring to FIG. 2, the cooling surface and its vicinity are shown in an enlarged view. Wettability of the liquid or solid material of the anti-sticking film 8 is one of the properties which results in the bonding of the anti-sticking film 8 on the cooling surface. Electric attracting force acting between the molecules of the cooling body and the anti-sticking film 8 as well as between the molecules of the anti-sticking film 8, is another property which results in bonding of the anti-sticking film 8 on the cooling surface of the rotary cooling body 4. Meanwhile, the droplets 5 which are impinged on the rotary cooling body 4, are forced into the anti-sticking film 8 and are then separated from the rotary cooling body 8 by the centrifugal force. Material 8*a* of the anti-sticking film 8 adheres to the flat powder 5 and is vaporized partially or totally during scattering.

A means 7 for forming the anti-sticking film 8 shown in FIG. 1 is brought into contact with the cooling surface of the rotary cooling body 4 at uniform pressure during spraying as illustrated in FIG. 1. Embodiments of the anti-sticking film-forming means 7 are described with reference to FIGS. 4 and 5.

Figure 4:
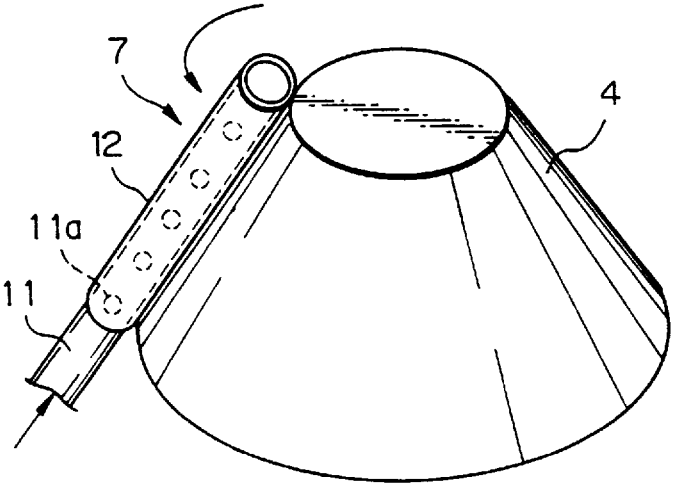
FIG. 4 illustrates a means for applying anti-sticking liquid.

The first embodiment of the anti-sticking film-forming means 7 shown in FIG. 4 is pertinent for applying the anti-sticking liquid. Referring to FIG. 4, the reference numeral 11 denotes a liquid-applying means, which consists of a hollow cylinder and is connected via a coupling with the front end of a tube (not shown) for supplying the anti-sticking material into the hollow cylinder. A number of apertures 11*a* are formed on the outer circumferential surface of the liquid-applying means 11. The liquid-applying means 11 is covered with porous, soft and cylindrical synthetic resin 12. The synthetic resin 12 is forced onto the cooling surface of the rotary cooling body 4 and hence is rotated together with the rotation of the rotary cooling body 4. When the anti-sticking liquid is supplied into the supplying tube at high pressure, the anti-sticking liquid permeates through the synthetic resin 12 and is uniformly applied on the cooling surface of the rotary cooling body 4. An anti-sticking film having uniform thickness is therefore thinly applied.

Figure 5:
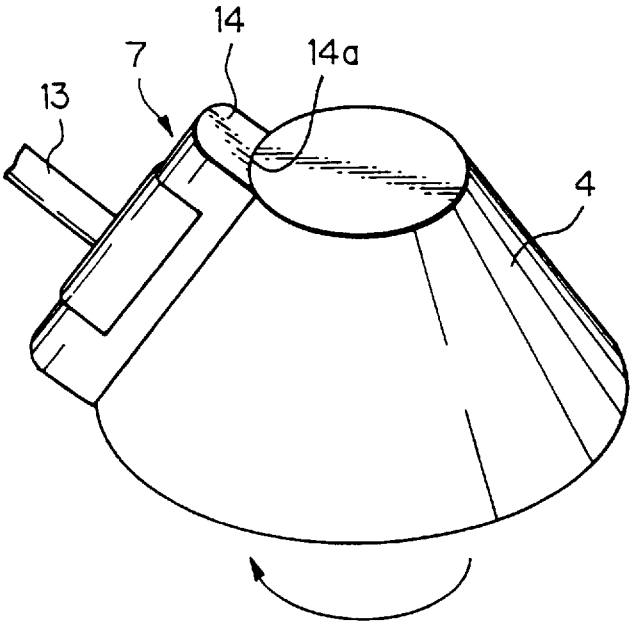
FIG. 5 illustrates a means for applying an anti-sticking solid.

Referring to FIG. 5, the second embodiment of the apparatus for applying an anti-sticking film is illustrated. This embodiment is pertinent for applying an anti-sticking solid. The application means 14 is fixed by a holder 13 and has an applying surface 14*a*, which is forced via the applying surface 14 onto the rotary cooling body 4 by means of a press mechanism (not shown). When the rotary cooling body 4 is rotated, the anti-sticking solid is melted or softened by the friction heat at the place of contact. The solid anti-sticking film is therefore applied uniformly and thinly onto the cooling surface.

EXAMPLE

Next, an example of a method for producing the flat powder is described. In this example, $Al_{88}Ni_7Mm_5$ (Mm indicates misch metal, and the liquidus temperature is 850° C.) was used. 2 kg of mother alloy having this composition was loaded in a crucible shown in FIG. 1, and then a vacuum in terms of $10^{-2}$ torr was created in the the melting chamber. Ar gas was then introduced into the melting chamber and the high-frequency melting was started. The high pressure gas used for finely dividing the melt stream was nitrogen and had a pressure of 70 kg/cm$^2$ . The temperature of the melt was 1150° C. The anti-sticking material used is given in Table 1. Also in table 1, is shown the yield of the flat powder.

TABLE 1

| | Anti-sticking material | Yield of flat powder (%) |
|---|---|---|
| 1st test | 1. Oleic acid | 70 |
| | 2. Linoleic acid | 60 |
| | 3. Stearic acid | 65 |
| | 4. Lauric acid | 55 |
| | 5. Methacrylic acid | 45 |
| 2nd test | 6. Soap (Naphthenate) | 48 |
| | 7. Beeswax | 50 |
| | 8. Stearic acid (10) + beeswax (90%) | 45 |
| | 9. Stearic acid (10) + beeswax (30) + palmitic acid (60) | 90 |
| | 10. Stearic acid (20) + beeswax (20) + palmitic acid (60) | 50 |
| | 11. Palmitic acid (90) + stearic acid (10) | 60 |
| | 12. Aluminum stearate (10) + beeswax (15) + palmitic acid (75) | 85 |
| | 13. Aluminum stearate (5) + beeswax (10) + palmitic acid (75) | 85 |
| Comparative Example | 14. No anti-sticking material used | 1.5 or less |
| | 15. A cooling body is directly cooled by liquid nitrogen | 1.5 or less |

In the 1st and 2nd tests and comparative example 14, the cooling body was cooled by water which is supplied in the cavity of the cooling body, while in the comparative example 15, the liquid nitrogen was directly blown onto the cooling surface together with the water cooling in the cavity. The numerals in the brackets indicate parts by weight. Numerals in the brackets of Table 1 indicate the blending quantity.

As is clear from Table 1, a flat powder of light metal-alloy, which has a tendency to stick on the cooling surface, can be produced at a high yield according to the present invention.

We claim:

1. A method for producing a flat powder of a metal, which comprises:

applying a film of an anti-sticking agent to the cooling surface of a rotating cooling body;

spraying finely divided droplets of liquid metal onto the cooling surface of the rotating cooling body, to which a film of the anti-sticking agent has been applied, to solidify the liquid metal and form the flat powder;

and separating the thus formed flat powder from said cooling surface, said anti-sticking agent consisting essentially of at least one liquid which is selected from the group consisting of lower fatty acids, and at least one solid selected from the group consisting of higher fatty acids.

2. A method according to claim 1, wherein said liquid metal consists of one material selected from the group consisting of aluminum, aluminum alloys, magnesium and magnesium alloys.

3. A method according to claim 2, wherein liquid metal is sprayed in finely divided droplets by applying gas pressure of 10 $kg/cm^2$ or more to the liquid metal.

4. A method according to claim 2, wherein said droplets are sprayed upon the cooling surface at a speed of 10 m/s or more.

5. A method according to claim 2, wherein said anti-sticking agent has a thickness of 100 $\mu$m or more before spraying of the finely divided droplets.

* * * * *